US007269979B2

(12) United States Patent
Lyu et al.

(10) Patent No.: US 7,269,979 B2
(45) Date of Patent: Sep. 18, 2007

(54) SET OF WASHING MACHINE AND DRYER AND REAR COVER ASSEMBLY THEREOF

(75) Inventors: Jae Chul Lyu, Changwon-shi (KR); Dong Yoon Kim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 572 days.

(21) Appl. No.: 10/412,304

(22) Filed: Apr. 14, 2003

(65) Prior Publication Data

US 2003/0196460 A1 Oct. 23, 2003

(30) Foreign Application Priority Data

Apr. 17, 2002 (KR) ..... 10-2002-0021033

(51) Int. Cl.
*D06F 39/12* (2006.01)

(52) U.S. Cl. ..... 68/3 R; 68/20; 34/603; 312/228

(58) Field of Classification Search ..... 68/3 R, 68/19.2, 20; D32/5, 6, 8
See application file for complete search history.

(56) References Cited

U.S. PATENT DOCUMENTS 2,816,429 A * 12/1957 Kurlancheek ..... 68/19.2
2,919,340 A * 12/1959 Jacobs ..... 219/209
3,034,226 A * 5/1962 Conlee ..... 34/596
3,035,428 A * 5/1962 Curtis et al. ..... 68/18 F
3,142,771 A * 7/1964 Wendt ..... 307/115
3,320,944 A * 5/1967 Hoppe ..... 126/214 B
3,331,226 A * 7/1967 Fink ..... 68/20
3,500,044 A * 3/1970 Treadway ..... 68/196
3,805,404 A * 4/1974 Gould ..... 34/75
3,824,813 A * 7/1974 Davis ..... 68/12.15
3,958,586 A * 5/1976 Schnelle ..... 134/68
4,003,613 A * 1/1977 Oakley ..... 312/293.2
4,243,197 A * 1/1981 Wright ..... 248/678
4,288,133 A * 9/1981 Deatherage ..... 312/279
4,429,817 A * 2/1984 Ikeda ..... 222/652
4,510,778 A * 4/1985 Cotton ..... 68/12.15
4,526,020 A * 7/1985 Fey et al. ..... 68/3 R (Continued)

FOREIGN PATENT DOCUMENTS

CA 2 330 236 * 11/2001

(Continued)

OTHER PUBLICATIONS

WIPO 98/21727 May 1998.*

*Primary Examiner*—Frankie L. Stinson
(74) *Attorney, Agent, or Firm*—McKenna, Long & Aldridge LLP

(57) ABSTRACT

A washing system may include a washing machine and dryer set that, for example, include top covers provided at upper sides of the washing machine and dryer; rear covers interchangeably provided at rear sides of the top covers, wherein the rear covers can maintain a single, unified appearance, wherein a front side of the rear covers each include an opening having a predetermined shape; control units detachably fixed within the openings, wherein the control units are capable of displaying an operational status of the washing machine and dryer and wherein the control units enable a user to input operation instructions; and controllers provided at lower sides of the rear covers for controlling operations of the washing machine and dryer.

22 Claims, 3 Drawing Sheets

U.S. PATENT DOCUMENTS 4,663,538 A * 5/1987 Cotton et al. ..... 307/38
4,785,643 A * 11/1988 Werner ..... 68/3 R
4,798,424 A * 1/1989 Coates et al. ..... 312/257.1
4,972,687 A * 11/1990 Czech et al. ..... 68/3 R
4,989,426 A * 2/1991 Kretchman et al. ..... 68/3 R
5,350,140 A * 9/1994 Ripley et al. ..... 248/27.1
5,518,309 A * 5/1996 St-Pierre ..... 312/140.4
5,574,623 A * 11/1996 Girard ..... 361/627
5,685,623 A * 11/1997 Katz et al. ..... 312/263
5,694,793 A * 12/1997 Nishimura et al. ..... 68/12.27
5,738,424 A * 4/1998 Katz et al. ..... 312/293.3
D398,102 S * 9/1998 Schober ..... D32/25
5,926,886 A * 7/1999 Braunschweig et al. ..... 8/158
5,971,510 A * 10/1999 Lickiss et al. ..... 312/263
6,119,678 A * 9/2000 Marchand ..... 126/39 B
6,262,013 B1 * 7/2001 Smith et al. ..... 510/529
6,371,583 B1 * 4/2002 Visin ..... 312/228
6,502,265 B2 * 1/2003 Blair et al. ..... 8/159
6,523,205 B1 * 2/2003 Broker et al. ..... 8/158
6,706,982 B1 * 3/2004 Knopp ..... 200/296
7,016,744 B2 * 3/2006 Howard et al. ..... 700/83

FOREIGN PATENT DOCUMENTS

DE 44 22 000 * 1/1996
GB 2 366 807 * 2/2002
JP 05-192490 * 1/1922
JP 08-164296 * 6/1996
JP 11-009889 * 6/1997
JP 11-285594 * 4/1998
JP 11-33285 * 2/1999
JP 11-077181 * 10/2000

* cited by examiner

SET OF WASHING MACHINE AND DRYER AND REAR COVER ASSEMBLY THEREOF

This application claims the benefit of the Korean Application No. P2002-21033 filed on Apr. 17, 2002, which is hereby incorporated by reference for all purposes as if fully set forth herein.

BACKGROUND OF THE INVENTION

1. Field of the Invention

The present invention relates to a washing system comprising a washing machine and dryer set, wherein washing and drying are carried out together. More particularly, the present invention relates to a rear cover assembly of the washing system.

2. Discussion of the Related Art

Generally, washing machines and dryers are viewed as complementary appliances and are therefore installed adjacent each other where necessary. Accordingly, washing systems, combining a washing machine and a dryer in a single set, have been recently commercialized. Such washing systems are typically fabricated such that the washing machine and the dryer are structurally independent from one another but have complementary functionality and are designed to give the appearance that components of the washing system are part of single system. Such washing systems typically include a control panel and protruding rear cover assembly installed at the washing machine and dryer, wherein the rear cover assemblies are designed to have substantially continuous, unified appearance.

Due to the internal structure of buildings, the positions exhaust structures for dryers and water supply/drainage structures for washing machines typically vary. Accordingly, the washing machine and the dryer of the washing system must be arranged adjacent the exhaust and water supply/drainage structures, respectively. While the arrangement of washing machines and dryers of washing systems may by adequate in light of the internal structure of houses, the arrangement may sometimes be inadequate in providing an aesthetic appearance.

For example, assuming a drainage structure is positioned to the left side of the an exhaust structure, wherein the exhaust structure is positioned to the right side of the drainage structure, the washing machine must be positioned to the left side of the dryer, and the dryer must be positioned to the right side of the washing machine. Accordingly, the shape and/or design of the rear cover assemblies (e.g., a semi-circle, partial circular arc, etc.) of the washing machine and dryer are formed to provide a substantially continuous, unified appearance. When, however, the positions of the drainage and exhaust structures are interchanged, the positions of the washing machine and the dryer must also be interchanged. When the washing machine and dryer are installed at the interchanged positions, the shape and/or design of the rear cover assemblies become substantially discontinuous in appearance. Accordingly, when positions of washing machine and dryer become interchanged, the external, aesthetic appearance of the entire washing system may be undesirably affected.

SUMMARY OF THE INVENTION

Accordingly, the present invention is directed to a washing system comprising a washing machine and dryer set having a rear cover assembly that substantially obviates one or more problems due to limitations and disadvantages of the related art.

An advantage of the present invention provides a washing system comprising a washing machine and dryer set having interchangeable rear cover assemblies capable of maintaining a substantially continuous, unified appearance even when positions of the washing machine and dryer are interchanged.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, a washing system may include a washing machine and dryer set that, for example, include top covers provided at upper sides of the washing machine and dryer; rear covers interchangeably provided at rear sides of the top covers, wherein the rear covers can maintain a single, unified appearance, wherein a front side of the rear covers each include an opening having a predetermined shape; control units detachably fixed within the openings, wherein the control units are capable of displaying an operational status of the washing machine and dryer and wherein the control units enable a user to input operation instructions; and controllers provided at lower sides of the rear covers for controlling operations of the washing machine and dryer.

In one aspect of the present invention, the control units may comprise a touch panel, wherein the touch panel includes a display region for displaying an image and an operation instruction input region within the display region enabling a user to input operation instructions.

In another aspect of the present invention, the control units may comprise a display unit for displaying an operational status and operation instruction input buttons.

In yet another aspect of the present invention, the top covers of the washing machine and dryer include a receiving section formed at a rear side of the top cover and depressed downward. The receiving section of the top covers may have a depth that greater than a height of the controllers.

In still another aspect of the invention, the rear covers may comprise base sections for uniformly increasing the height of the rear covers. The base sections may extend the rear covers to a height greater than a height of each of the controllers.

In an additional aspect of the present invention, the washing machine and dryer may each include electrical wires for connecting the control units and the controllers, wherein the electrical wires have lengths suitable for connecting the control units to the controllers irrespective of the interchangeable positions of the rear covers on the washing machine or dryer.

In another aspect of the present invention, heights of first ends of each rear covers may be different than heights of second ends of each rear cover.

In a further aspect of the present invention, the rear covers may be provided on the washing machine and dryer to provide a shape and/or design having a substantially continuous, unified appearance.

In still a further aspect of the present invention, the rear covers of the washing machine and of the dryer may be substantially symmetric.

In accordance with further principles of the present invention, a rear cover assembly for a washing system comprising a washing machine and dryer set may, for example, include a rear cover detachably fixed to a rear side of a top cover arranged at an upper side of a washing machine or dryer, wherein a front side of the rear cover comprises an opening having a predetermined shape; and a control unit detachably fixed within the opening of the rear cover, wherein the control unit is capable of displaying an operational status of the washing machine or the dryer and enables a user to input operation instructions, wherein the rear cover assembly provides a substantially uniform appearance within a set of at least two arbitrary appliances including, for example, washing machines and dryers, and wherein the rear cover is interchangeable between the at least two arbitrary appliances such that a shape and/or design having a substantially continuous, unified appearance may be maintained.

In one aspect of the present invention, the control unit may comprise a touch panel, wherein the touch panel includes a display region for displaying an image and an operation instruction input region within the display region enabling a user to input operation instructions.

In another aspect of the present invention, the control unit may comprise a display unit for displaying an operational status and operation instruction input buttons.

In still another aspect of the present invention, a height of a first end of the rear cover may be different than a height of a right end of the rear cover.

In a further aspect of the present invention, the rear cover of the washing machine or dryer provide a shape and/or design having a substantially continuous, unified appearance.

In still a further aspect of the present invention, rear covers may be interchangeably provided the washing machine and dryer, wherein the rear covers are substantially symmetric.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings. Wherever possible, the same reference numbers will be used throughout the drawings to refer to the same or like parts.

Figure 1:
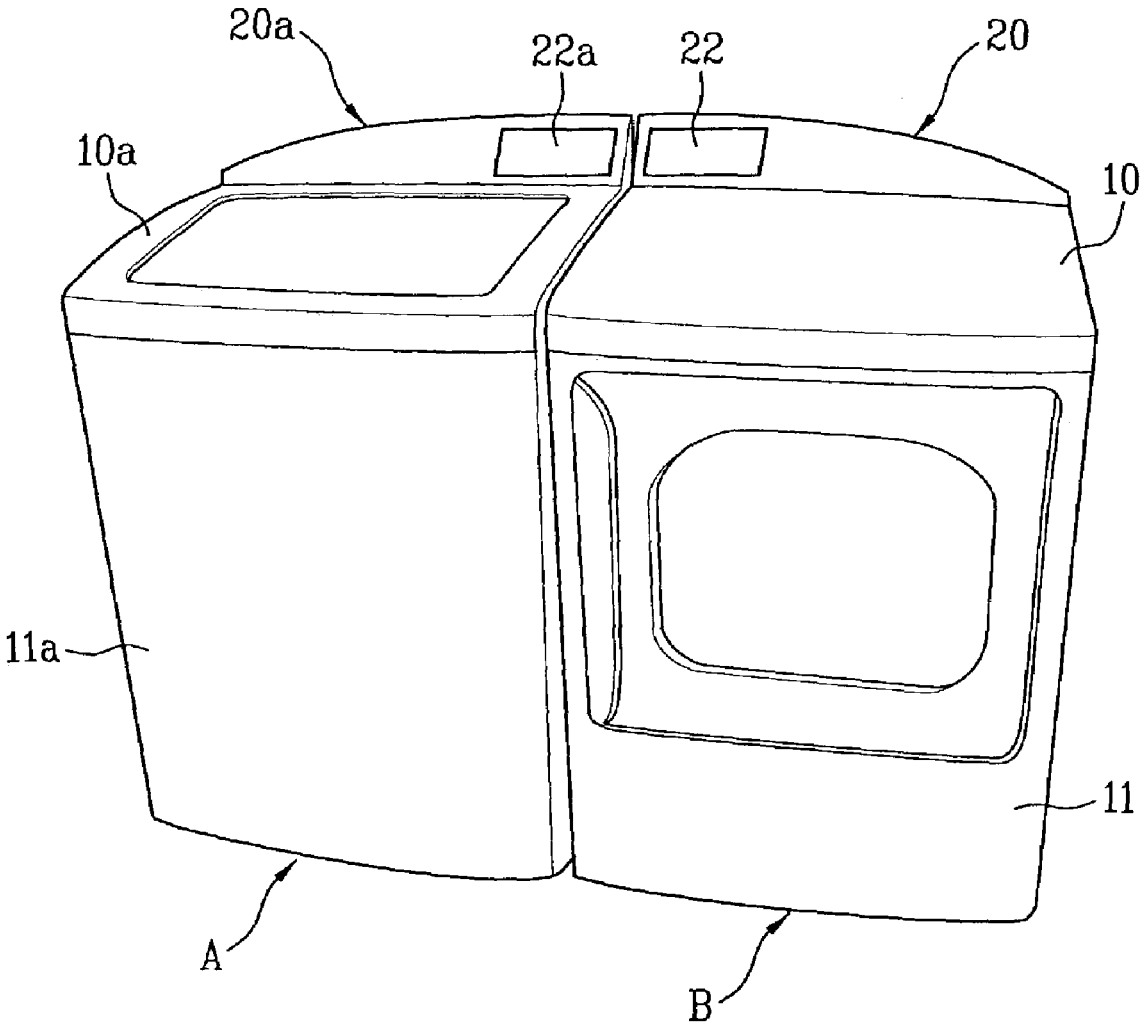
FIG. 1 illustrates a perspective view of a washing system according to the principles of the present invention.
Figure 2:
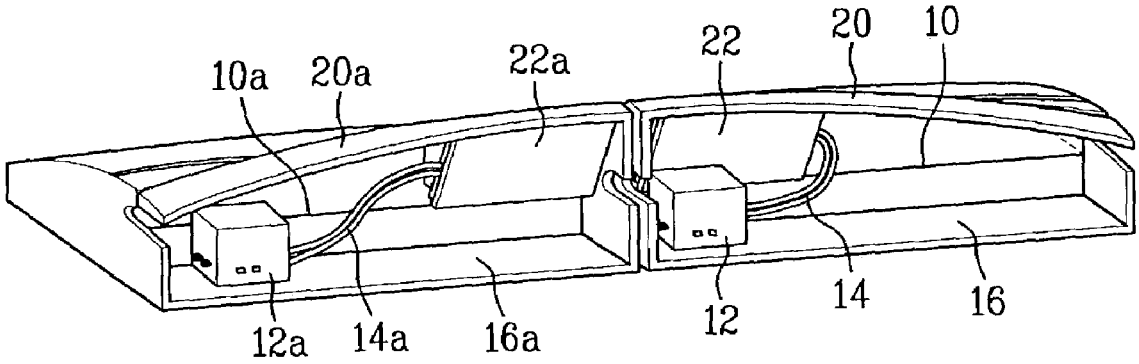
FIG. 2 illustrates a rear perspective view of a rear cover assembly in the washing system according to a first aspect of the present invention.

FIG. 1 illustrates a perspective view of a washing machine and dryer set according to the principles of the present invention, and FIG. 2 illustrates a rear perspective view of a rear cover assembly in the washing machine and dryer set according to a first aspect of the present invention.

Referring to FIGS. 1 and 2, a washing system may, for example comprise a washing machine (A) and dryer (B) set wherein the washing machine (A) and dryer (B) each have independent and separately operating structures. Both the washing machine (A) and the dryer (B) may, for example, comprise a housing and various elements within the housing for performing washing and drying operations, respectively. The housings of the washing machine (A) and dryer (B) may comprise a cabinet 11*a* and 11, respectively, a top cover 10*a* and 10, respectively, provided at an upper side of the cabinet 11*a* and 11, respectively, and a rear cover 20*a* and 20, respectively, provided at the rear of the top cover 10*a* and 10, respectively. The cabinets 11*a* and 11 may be formed to house and protect main elements of the washing machine (A) and dryer (B), respectively, installed therein. The top covers 10*a* and 10 may cover the upper sides of the cabinets 11*a* and 11, respectively, to protect the main elements. The rear covers 20*a* and 20 may support control units 22*a* and 22 for controlling an operation of the washing machine (A) and the dryer (B), respectively. The rear covers 20*a* and 20 may also cover controllers 12*a* and 12 operably connected with the control units 22*a* and 22, respectively. According to the principles of the present invention, a door of the washing machine (A) may be provided within the top cover 10*a* and a door of the dryer (B) may be provided within the cabinet 11, depending on the arrangement of the main elements.

In one aspect of the present invention, a washing tub and driving means for driving the washing tub may be arranged within the housing of the washing machine (A). Laundry may be loaded into the washing tub through the door and may be washed and dewatered according to a rotational motion of the washing tub. In one aspect of the present invention, a drying drum, driving means for rotating the drying drum, and units for heating air may be arranged within the housing of the dryer (B). Laundry which has been washed in, for example, washing machine (A) may be loaded into the drying drum through the door of the dryer and dried according to the heating units. The drying drum may be rotated according to the driving means such that the laundry may be efficiently dried. Accordingly, the general washing cycle may begin at the washing machine (A) and end at the dryer (B).

According to the principles of the present invention, the washing machine (A) and dryer (B) may be arranged adjacent each other to form the washing system. By arranging the washing machine (A) and dryer (B) adjacent each other, a washing cycle can be performed both conveniently and efficiently. For example, a user may wash laundry in the washing machine (A), unload the washed laundry from the washing machine (A), place it into the dryer (B), and dry it in the dryer (B), which is adjacent the washing machine (A). In one aspect of the present invention, the washing machine (A) and the dryer (B) within the washing system may have substantially the same height and width as shown in FIG. 1.

In another aspect of the present invention, rear covers 20*a* and 20 may protrude to a predetermined height from above the top covers 10*a* and 10 to facilitate user manipulation of the control units 22*a* and 22.

According to the principles of the present invention, shapes and/or designs of the rear covers 20*a* and 20 may be combined in a predetermined manner to exhibit a substantially continuous, unified appearance. For example, as shown in FIG. 1, the rear covers 20*a* and 20 may be provided adjacent each other in a predetermined manner to form substantially continuous, unified semi-elliptical shape. It will be appreciated that the principles of the present invention allow substantially any design and/or shape to be realized when the rear covers 20*a* and 20 are so arranged adjacent each other.

Referring to FIG. 2, the rear covers 20*a* and 20 may be detachably fixed to rear portions of the top covers 10*a* and 10 by various fixing means (e.g., via screw, hooks, etc.). Further, an opening may be formed at a front side of the rear covers 20*a* and 20, wherein control units 22*a* and 22 may be detachably fixed within each of the openings.

When rear covers 20*a* and 20 are provided adjacent each other as shown in FIGS. 1 and 2, a shape and/or design having a substantially continuous, unified appearance (e.g., smooth, semi-elliptical, etc.) may be attained. In one aspect of the present invention, the rear covers 20*a* and 20*b* may be formed so as to be either asymmetric or substantially symmetric to each other. In one aspect of the present invention, forming rear covers 20*a* and 20 to be substantially symmetric to each other may facilitate their design and fabrication.

In one aspect of the present invention, the control units 22*a* and 22 may comprise touch panels. Accordingly, the touch panels may comprise a display region for displaying images and an operational status of the washing machine (A) or dryer (B). An operation instruction region may be provided within the display region, wherein the operation instruction region enables users to provide operational instructions to the washing machine (A) or dryer (B) by selectively pressing operation instruction input regions of the touch panel.

In another aspect of the present invention, the control units 22*a* and 22 may comprise a screen for only displaying images, unlike the touch panel mentioned above. Further, control units 22*a* and 22 comprising a screen for only displaying images may further include a plurality of operation instruction buttons provided separately from the screen. Accordingly, the operation instruction buttons may be manipulated by a user for inputting operational instructions. Electrical signals capable of controlling various operations may be generated, for example, by pressing the operation instruction buttons.

In another aspect of the present invention, the control units 22*a* and 22 need not be of the same type. For example, one of the control units 22*a* or 22 may be embodied as a control unit of one of the aforementioned aspects of the present invention while the other of the control units may be embodied as the control unit of the other of the aforementioned aspects of the present invention.

According to the principles of the present invention controllers 12*a* and 12 operate the washing machine (A) and the dryer (B), respectively, and perform specific functions according to the control units 22*a* and 22, respectively. Information related with the operation of the washing machine (A) and the dryer (B) may be provided to the user through the control units 22*a* and 22. If the rear covers 20*a* and 20 are replaced, the separatable control units 22*a* and 22 may be separated from the replaced rear covers and may be recoupled to the new rear covers.

Referring to FIG. 2, the washing machine (A) may be to the left of the dryer (B), such that the dryer (B) is arranged to the right of the washing machine (A). However, it may be necessary that the dryer (B) be arranged to the left of the washing machine (A), such that the washing machine (A) is arranged to the right of the dryer (B), depending upon relative positions of the drainage hole and/or exhaust hole within a building.

Figure 3:
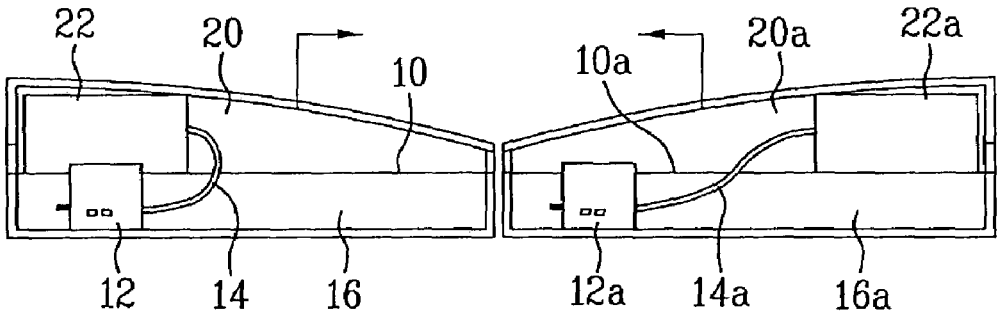
FIG. 3 illustrates a rear view of the rear cover assembly wherein the positions of a washing machine and dryer are interchanged and wherein the positions of rear covers are not interchanged with respect to the washing machine and dryer.

FIG. 3 illustrates a rear view of the rear cover assembly wherein the positions of the washing machine and dryer are interchanged and the rear covers are arranged at the interchanged positions.

Referring to FIG. 3, when the positions of the rear covers 20*a* and 20 are interchanged in accordance with the interchanged positions of the washing machine (A) and dryer (B), the appearance of the washing system may be deleteriously affected. For example, the design and/or shape of the rear covers 20*a* and 20 becomes substantially discontinuous in appearance and thus aesthetically unappealing. Therefore, and in accordance with the principles of the present invention, the positions of the rear covers 20*a* and 20 may be interchanged with respect to the washing machine (A) and dryer (B) such that the design and/or shape of the rear covers 20*a* and 20 may provide a substantially continuous, unified appearance.

According to the principles of the present invention, positions of the rear covers 20*a* and 20 may be interchanged with respect to the washing machine (A) and dryer (B). Accordingly, the rear covers 20*a* and 20 may be separated from the top covers 10*a* and 10 and the control units 22*a* and 22 may be removed from within their respective openings in the rear covers 20*a* and 20. Next, the positions of the rear covers 20*a* and 20 may be interchanged with respect to the washing machine (A) and the dryer (B) wherein the rear cover 20*a* is arranged on the upper side of top cover 10 and the rear cover 20 is arranged on the upper side of top cover 10*a* and control units 22*a* and 22 are arranged within the openings in rear covers 20 and 20*a*, respectively, resulting in the rear cover assembly shown in FIG. 4.

According to the principles of the present invention, the construction of upper side of top covers 10*a* and 10 is substantially the same to facilitate the interchanging positions of the rear covers 20*a* and 20. In one aspect of the present invention, the construction of the upper side of the top covers 10*a* and 10 of the washing machine (A) and dryer (B) are substantially identical. In another aspect of the present invention, the washing machine (A) has substantially the same exterior dimensions as the dryer (B) while the rear covers 20*a* and 20 are substantially the same size and are fabricated in substantially the same manner.

By interchanging the positions of the rear covers 20*a* and 20 with respect to the washing machine (A) and dryer (B), a substantially continuous design and/or shape may be maintained, thereby attaining the substantially continuous, unified appearance even when positions of the washing machine (A) and dryer (B) are interchanged.

An installation structure of the rear cover and the controller in accordance with a first aspect of the present invention will now be described in greater detail.

Referring to FIG. 2, receiving sections 16*a* and 16, may be provided as recesses at rear sides of top covers 10*a* and 10, respectively, and may be formed to a predetermined depth. Controllers 12*a* and 12 may be installed within the receiving sections for controlling operations of the washing machine (A) and dryer (B), respectively, in accordance with a user's inputted operating instruction.

According to the principles of the present invention, the controllers 12*a* and 12 may be formed to a predetermined height such that they do not interfere with the rear covers 20*a* and 20 installed above (e.g., the controllers 12*a* and 12 do not prevent the rear covers 20*a* and 20 from being properly fixed to the top covers 10*a* and 10). As mentioned above, if the installation positions of the washing machine and dryer become interchanged, a substantially discontinuous design and/or shape in the rear cover assembly may be caused if the rear covers cannot also be interchanged with respect to the washing machine and dryer. Therefore, the positions of the rear covers 20*a* and 20 of the washing machine (A) and dryer (B), respectively, may be interchanged to recover the substantially continuous, unified appearance. In one aspect of the present invention, the substantially continuous, unified appearance may comprise a semi-circular arc or other shape wherein a height at first ends of the rear covers 20*a* and 20 is different than a height at second ends of the rear covers 20*a* and 20 and wherein the second ends of both rear covers 20*a* and 20 are adjacent each other.

Referring to FIG. 2, the height of first end of the rear cover 20*a* is lower than the height of second ends of the rear cover 20*a*. Further, controllers 12*a* and 12 of the washing machine (A) and dryer (B), respectively, have a substantially uniform height and are arranged within the portions of the receiving sections below and proximate the first end of the rear cover 20*a*. The receiving section 16*a* may have a substantially uniform depth that is sufficient to prevent the controller 12*a* from interfering with, or contacting, the rear cover 20*a*. In one aspect of the present invention, the receiving section 16*a* may have a depth that is greater than a height of the controller 12*a*. Accordingly, the controller 12*a* of the washing machine (A) may be installed at the receiving section 16*a* formed at the rear side of the top cover 10*a*, proximate the first end of the rear cover 20*a*, and be arranged so as not to interfere with the rear cover 20*a*. In one aspect of the present invention, the relationship between the depth of the receiving section 16*a* and the height of the controller 12*a* is maintained even when the positions of the washing machine (A) and the dryer (B) are interchanged.

Figure 4:
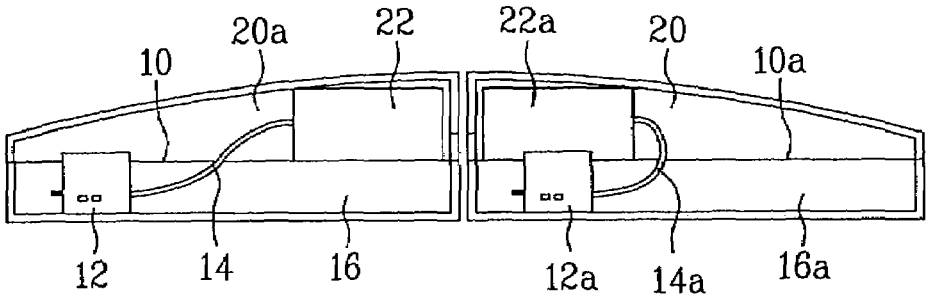
FIG. 4 illustrates a rear view of the rear cover assembly wherein the positions of a washing machine and dryer are interchanged and wherein the positions of rear covers are interchanged with respect to the washing machine and dryer.

Referring to FIG. 4, when the positions of the washing machine (A) and dryer (B) are interchanged, the positions of the rear covers 20*a* and 20 may be interchanged with respect to the washing machine (A) and dryer (B). As mentioned above, the first end of the rear cover 20*a* is lower than the second end. The receiving section 16 may have a substantially uniform depth that is sufficient to prevent the controller 12 from interfering with, or contacting, the rear cover 20*a*. In one aspect of the present invention, the receiving section 16 may have a depth that is greater than a height of the controller 12. Accordingly, the controller 12 of the dryer (B) may be installed at the receiving section 16 formed at the rear side of the top cover 10, proximate the first end of the rear cover 20*a*, and be arranged so as not to interfere with the rear cover 20*a*. Accordingly, the controllers 12*a* and 12 of the washing machine (A) and the dryer (B), respectively, never interfere with, or contact, rear covers 20*a* and 20.

Figure 5:
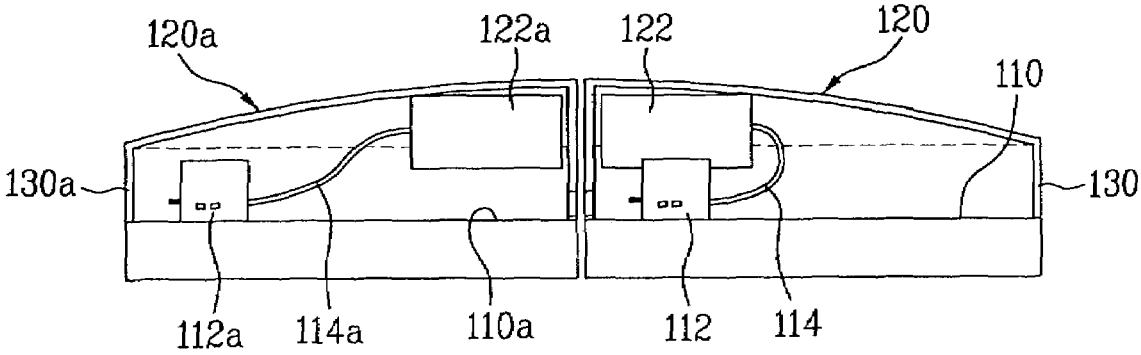
FIG. 5 illustrates a rear view of a rear cover assembly in the washing machine and dryer set according to a second aspect of the present invention.

FIG. 5 illustrates a rear view of a rear cover assembly in the washing machine and dryer set according to a second aspect of the present invention.

Referring to FIG. 5, receiving sections may not be provided within the top covers 110*a* and 110. Accordingly, controllers 112*a* and 112 of the washing machine (A) and dryer (B), respectively, may be installed directly on the upper surfaces of the rear sides of top covers 110*a* and 110. In one aspect of the present invention, the rear covers 120*a* and 120 may be provided with base sections 130*a* and 130, respectively, which uniformly increase the height of the rear covers 120*a* and 120 to prevent controllers 112*a* and 112 from interfering with, or contacting, rear covers 120*a* and 120, respectively. In one aspect of the present invention, the base sections 130*a* and 130 may have a height that is greater than a height of controllers 112*a* and 112. Accordingly, the controllers 112*a* and 112 of the washing machine (A) and the dryer (B), respectively, never interfere with, or contact, rear covers 120*a* and 120 due to the presence of the base sections 130*a* and 130. In one aspect of the present invention, the rear covers 120*a* and 120 may be formed to have a substantially continuous, unified shape and/or design (e.g., a semi-circular arc, etc.) above base sections 130*a* and 130. Further, and similarly to the first aspect of the invention described above, the position of the rear cover 120*a* may be interchangeable with the rear cover 120. Further shown in FIG. 5, there are provided control units 122*a* and 122, substantially similar to control units 22*a* and 22, respectively, electrically connectable to the controllers 112*a* and 112 via electrical wires 114*a* and 114.

According to the principles of the present invention, the base sections 130*a* and 130 may be formed to a height greater than a height of the controllers 112*a* and 112. Accordingly, controllers 112*a* and 112 may be prevented from interfering with the rear covers 120*a* and 120 when the positions of the rear covers 120*a* and 120 are interchanged with respect to the washing machine (A) and dryer (B).

Connection structures of electrical wires between the control units and the controllers will now be described in greater detail below.

Referring to FIG. 2, the rear covers 20*a* and may include openings, within which control units 22*a* and 22 may be interchangeably fixed. In one aspect of the present invention, the control unit 22*a* may be detachably fixed within an opening proximate the second end of the rear cover 20*a* and the control unit 22 may be detachably fixed within an opening proximate the second end of the rear cover 20, wherein second ends of the rear covers 20*a* and 20 are adjacent each other. The controllers 12*a* and 12 of the washing machine (A) and dryer (B), respectively, may be positioned at the rear sides of the top covers 10*a* and 10. The controllers 12*a* and 12 of the washing machine (A) and the dryer (B), respectively, may each be arranged proximate the first end of the rear cover 20*a* and proximate the second end of the rear cover 20.

As shown in FIG. 2, the distance between the controller 12*a* of the washing machine (A) and the control unit 22*a* is greater than the distance between the controller 12 of the dryer 12 and the control unit 22. Accordingly, the length of an electrical wire 14*a* for electrically connecting the controller 12*a* and the control unit 22*a* is greater than the length of an electrical wire 14 for electrically connecting the controller 12 and the control unit 22.

Referring to FIG. 4, when the installation positions of the washing machine (A) and the dryer (B) are interchanged, the positions of the rear covers 20*a* and 20 are interchanged with respect to the washing machine (A) and dryer (B). Accordingly, the distance between the controller 12 of the dryer (B) and the control unit 22 is greater than the distance between the controller 12*a* of the washing machine (A) and the control unit 22*a*. Therefore, the length of electrical wire 14 for electrically connecting the controller 12 and the control unit 22 is greater than the length of electrical wire 14*a* for electrically connecting the controller 12*a* and the control unit 22*a*.

In view of the above, the electrical wires 14*a* and 14 may be provided at a length suitable for connecting the control units 22*a* and 22 to the controllers 12*a* and 12, respectively, irrespective of whether rear covers 20*a* and 20 are arranged on the washing machine (A) or dryer (B). In one aspect of the present invention, lengths of the electrical wires 14*a* and 14 may be provided to correspond to the relative locations of the controllers 12*a* and 12 with respect to the openings in rear covers 20*a* and 20.

While the aforementioned embodiments illustrate and describe a washing system comprising a single washing machine and a single dryer set, it will be appreciated that the principles of the present invention are not limited only what has been illustrated and described but readily extend to other embodiments. For example, the washing system may comprise a plurality of washing machines and/or a plurality of dryers wherein the rear covers are interchangeable with each other as described above such that the washing system may have a substantially continuous, unified appearance regardless of the relative positions of the individual washing system components.

According to the principles of the present invention, a washing system comprising a washing machine and dryer set may maintain a substantially continuous, unified appearance even if positions of individual components of the washing system are interchanged.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A washing machine and dryer set, comprising:

top covers respectively provided at upper sides of the washing machine and dryer;

rear covers provided at rear sides of the top covers, wherein each rear cover is configured to be interchangeable with the other, wherein each of the rear covers includes a first end, a second end, a front side, and an opening in the front side and the rear cover associated with the washing machine has a shape different from the rear cover associated with the dryer;

control units detachably fixed within the openings of the rear covers; and controllers arranged proximate the control units for controlling an operation of the washing machine and dryer.

2. The set of claim 1, wherein at least one control unit includes a touch panel for enabling a user to input an operation instruction.

3. The set of claim 2, wherein the touch panel comprises:

a display region for displaying an image; and an operation instruction input region within the display region for enabling the user to input the operation instruction.

4. The set of claim 1, wherein at least one the control unit comprises:

a display unit for displaying an operational status; and at least one operation instruction input button.

5. The set of claim 1, wherein a height of the first end is different from a height of the second end.

6. The set of claim 1, wherein a substantially continuous appearance is providable by adjacent rear covers.

7. The set of claim 6, wherein the rear covers are substantially symmetric to each other.

8. The set of claim 1, further comprising receiving sections provided as recesses within rear sides of each of the top covers, wherein the controllers are provided within the receiving sections.

9. The set of claim 8, wherein a depth of each receiving section is sufficient to prevent the controllers from interfering with the rear covers.

10. The set of claim 8, wherein a depth of each receiving section is greater than a height of each of the controllers.

11. The set of claim 1, wherein the controllers are provided on the top covers; and the controllers do not interfere with the rear covers.

12. The set of claim 11, wherein the controllers do not contact the rear covers.

13. The set of claim 1, further comprising electrical wires connecting the control units to the controllers.

14. The set of claim 13, wherein the electrical wires have lengths corresponding relative locations of the controllers with respect to the openings.

15. A rear cover assembly for a washing machine and dryer, comprising:

a first rear cover detachably fixed to a rear side of a top cover at an upper side of the washing machine and a second rear cover detachably fixed to a rear side of a top cover at an upper side of the dryer, the rear covers each comprising a front side and an opening in the front side, and a control unit detachably fixed within at least one rear cover opening, wherein the rear cover assembly forms a substantially uniform appearance wherein the rear covers are interchangeable between the washing machine and the dryer and the first rear cover has a shape different from the second rear cover.

16. The rear cover assembly of claim 15, wherein the control unit is operably coupled to at least one selected from the group consisting the washing machine and the dryer.

17. The rear cover assembly of claim 16, wherein the control unit comprises:

a display unit for displaying an operational status; and at least one operation instruction input button.

18. The rear cover assembly of claim 15, wherein the control unit includes a touch panel.

19. The rear cover assembly of claim 18, wherein the touch panel comprises:

a display region for displaying an image; and an operation instruction input region within the display region for enabling a user to input an operation instruction.

20. The rear cover assembly of claim 15, wherein the first rear cover and the second rear cover each comprise a first end and a second end, wherein a height of the first end is different from a height of the second end.

21. The rear cover assembly of claim 15, wherein the first rear cover and the second rear cover are symmetrically shaped with respect to each other.

22. A washing machine, comprising:

a cabinet including side panels, wherein the cabinet houses a washing tub;

a door to provide access to the tub;

a top cover; and a rear cover detachably fixed to the top cover wherein the rear cover is configured to be interchangeable with a rear cover of a dryer, wherein the rear cover of the washing machine has a shape different from the rear cover of the dryer.

* * * * *